US009675173B2

(12) United States Patent
Chen et al.

(10) Patent No.: US 9,675,173 B2
(45) Date of Patent: Jun. 13, 2017

(54) DRAWER SIDEWALL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Fang-Cheng Su, Kaohsiung (TW); Shih-Lung Huang, Kaohsiung (TW); Ci-Bin Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/212,593

(22) Filed: Jul. 18, 2016

(65) Prior Publication Data

US 2017/0135471 A1 May 18, 2017

(30) Foreign Application Priority Data

Nov. 12, 2015 (TW) ..... 104137460 A

(51) Int. Cl.
*A47B 88/04* (2006.01)
*A47B 88/00* (2017.01)

(52) U.S. Cl.
CPC ..... *A47B 88/0014* (2013.01); *A47B 88/04* (2013.01); *A47B 2210/02* (2013.01)

(58) Field of Classification Search
CPC ..... A47B 88/40; A47B 88/90; A47B 68/04; A47B 88/0014; A47B 2210/02
See application file for complete search history.

(56) References Cited

U.S. PATENT DOCUMENTS

| | | | | | |
|---|---|---|---|---|---|
| 5,197,791 | A * | 3/1993 | Domenig | A47B 88/0014 | 312/184 |
| 5,292,190 | A * | 3/1994 | Lautenschlager | A47B 88/0014 | 312/330.1 |
| 5,419,630 | A * | 5/1995 | Rock | A47B 88/0014 | 312/334.4 |
| 5,492,400 | A * | 2/1996 | Rock | A47B 88/10 | 312/331 |
| 5,494,348 | A * | 2/1996 | Grabher | A47B 88/0014 | 312/263 |
| 6,095,627 | A * | 8/2000 | Sutterlutti | A47B 88/0014 | 312/263 |
| 8,491,069 | B2 | 7/2013 | Haemmerle | | |
| 2006/0005502 | A1* | 1/2006 | Bodingbauer | A47B 88/00 | 52/842 |
| 2014/0049148 | A1 | 2/2014 | Gasser | | |
| 2014/0285080 | A1* | 9/2014 | Feuerstein | A47B 88/0014 | 312/330.1 |

* cited by examiner

*Primary Examiner* — Daniel Rohrhoff
(74) *Attorney, Agent, or Firm* — Rosenberg, Klein & Lee

(57) ABSTRACT

A drawer sidewall assembly includes an inner wall, an outer wall, and a buffer. The buffer is provided between the inner wall and the outer wall to reduce the gap formed by connecting the inner wall and the outer wall and to absorb vibrations.

7 Claims, 6 Drawing Sheets

DRAWER SIDEWALL ASSEMBLY

FIELD OF THE INVENTION

The present invention relates to a sidewall assembly of a drawer and more particularly to a drawer sidewall which includes an inner wall, an outer wall, and a buffer mounted between the inner and outer walls to reduce the gap between the inner and outer walls and absorb vibrations.

BACKGROUND OF THE INVENTION

US Patent Application Publication No. 2014/0049148 A1 discloses a rail system for a drawer, wherein the rail system includes a pair of drawer sidewalls each includes an inner wall and an outer wall riveted together such that other components can be mounted between the inner and outer walls. The pair of drawer sidewalls are connected to a front end panel, a rear end panel, and a bottom panel to form a complete drawer. Moreover, each drawer sidewall is connected with a carrier and is mounted to a slide assembly via the carrier. The disclosure of this US patent application is incorporated herein by reference. As the inner and outer walls of the drawer sidewall are connected by riveting, tolerances of manufacture may prevent the inner and outer walls from being pressed firmly against each other and therefore create an undesirable gap between the inner and outer walls. In addition, vibrations may result from pulling or pushing the drawer and cause damage to the components mounted between the inner and outer walls.

SUMMARY OF THE INVENTION

The present invention relates to a drawer sidewall assembly featuring a buffer mounted between the inner and outer walls of a drawer sidewall to not only reduce the gap between the inner and outer walls but also absorb vibrations.

According to one aspect of the present invention, a drawer sidewall assembly includes an inner wall, an outer wall connected to the inner wall, and a buffer between the inner wall and the outer wall.

Preferably, the inner wall has a mounting hole and at least one engaging feature on the hole wall of the mounting hole, and the buffer is mounted in the mounting hole of the inner wall and is temporarily fixed in position by the at least one engaging feature engaging with the buffer.

Preferably, the inner wall includes a lateral section and an upper section connected to the lateral section and having a first bent section, and the outer wall has a lateral portion with an upper end portion pressed against the first bent section of the inner wall.

Preferably, the buffer includes a first buffer portion and a second buffer portion connected to the first buffer portion. The at least one engaging feature engages with the first buffer portion while a contact portion of the outer wall is pressed against the second buffer portion of the buffer.

Preferably, the upper section of the inner wall further has a second bent section connected to the first bent section and a vertical section connected to the second bent section, and the outer wall has a fastening portion fastened with the vertical section of the inner wall.

Preferably, the inner wall and the outer wall are fixed to each other at least partially by riveting or soldering.

Preferably, the drawer sidewall assembly further includes a carrier connected to the inner wall.

Preferably, the carrier is fixed to the inner wall by riveting or soldering.

DETAILED DESCRIPTION OF THE INVENTION

Figure 1:
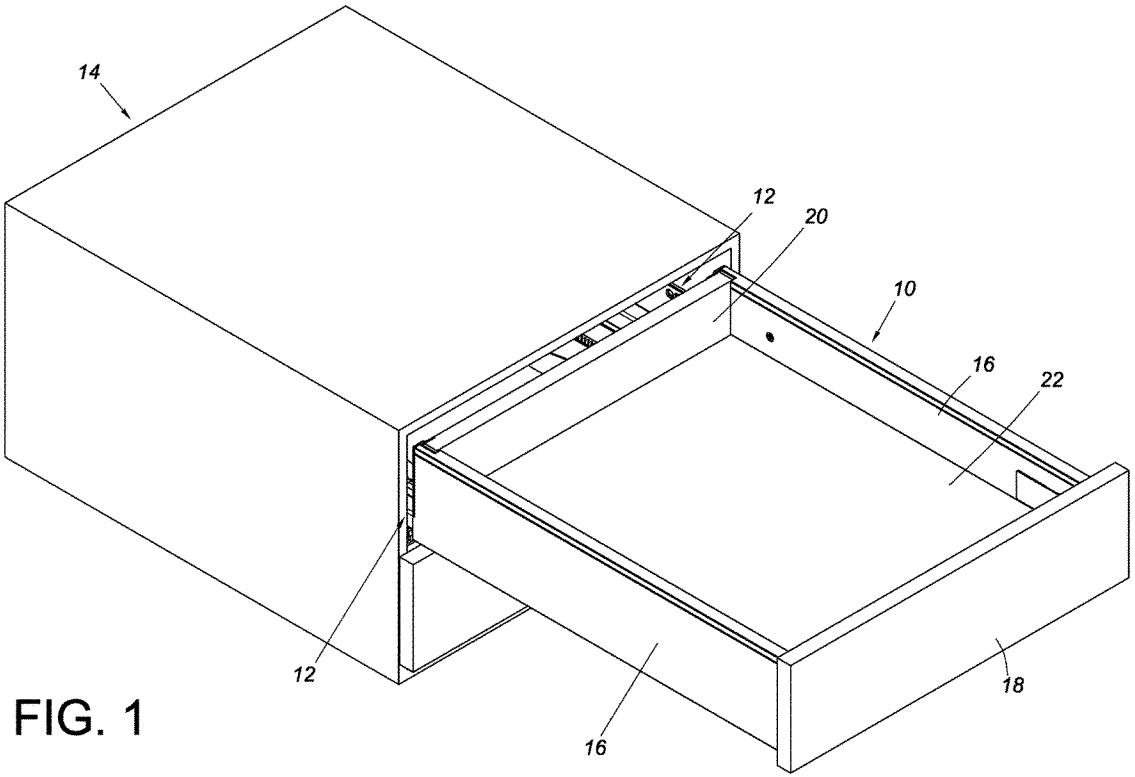
FIG. 1 is a perspective view showing how the drawer in an embodiment of the present invention is mounted to a cabinet via a pair of slide assemblies.

Referring to FIG. 1, a drawer 10 is mounted to a cabinet 14 via a pair of slide assemblies 12. The slide assemblies 12 allow the drawer 10 to be pulled out of and pushed back into the cabinet 14. The drawer 10 includes a pair of drawer sidewall assemblies 16, a front end panel 18, a rear end panel 20, and a bottom panel 22.

Figure 2:
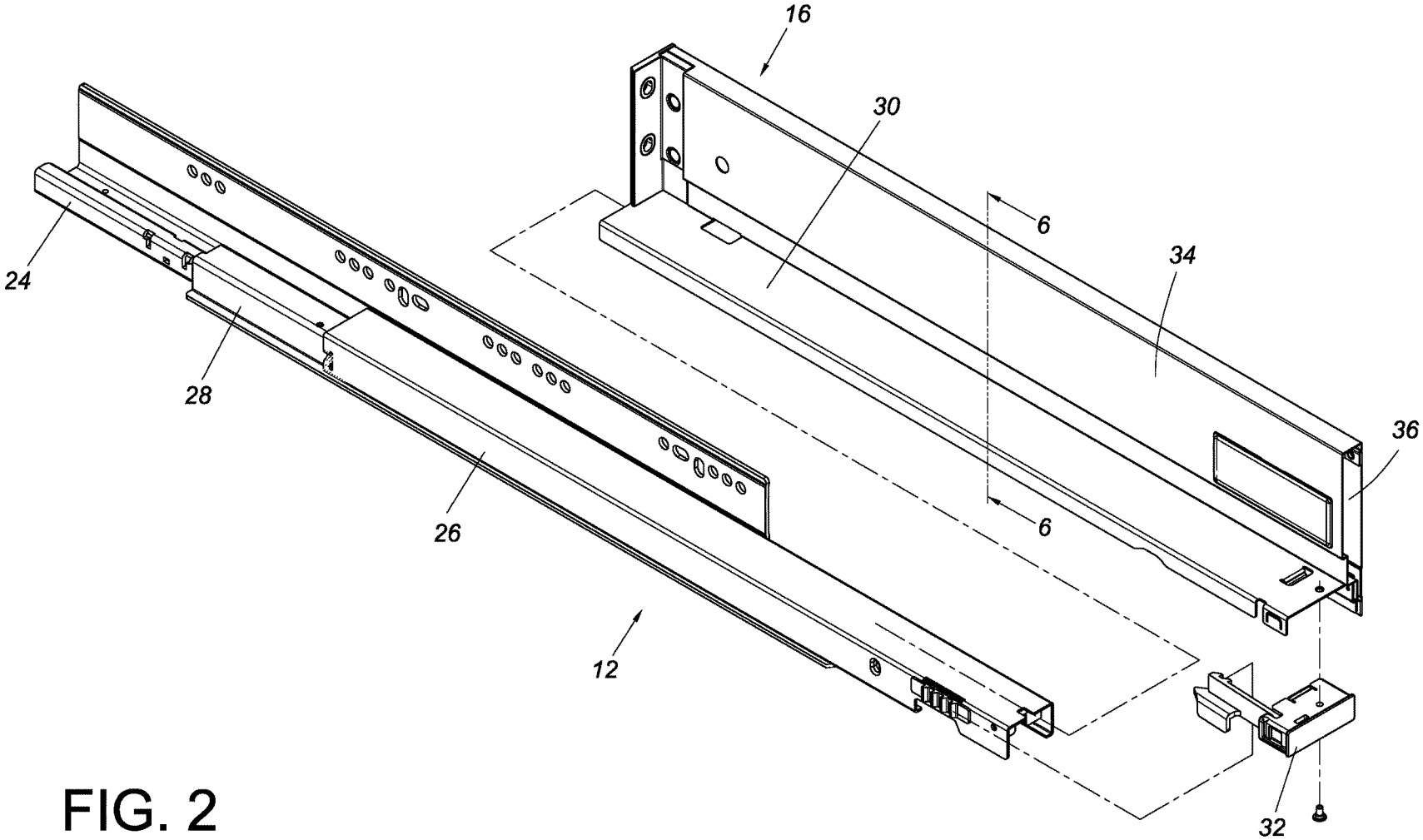
FIG. 2 is an exploded perspective view showing how the drawer sidewall assembly on one side of the drawer in FIG. 1 is mounted to the second rail of the corresponding slide assembly via an engaging member.

FIG. 2 shows the mounting relationship between one of the drawer sidewall assemblies 16 and the corresponding slide assembly 12. As shown in the drawing, the slide assembly 12 includes a first rail 24 and a second rail 26 which can be displaced with respect to the first rail 24. The slide assembly 12 further includes a third rail 28 movably connected between the first rail 24 and the second rail 26 in order to increase the distance by which the second rail 26 can be pulled out with respect to the first rail 24. The drawer sidewall assembly 16 includes a carrier 30 to be mounted on the second rail 26 and is fixed to the second rail 26 by an engaging member 32, which engages with both the carrier 30 and the second rail 26. The drawer sidewall assembly 16 also includes an inner wall 34 and an outer wall 36.

Figure 3:
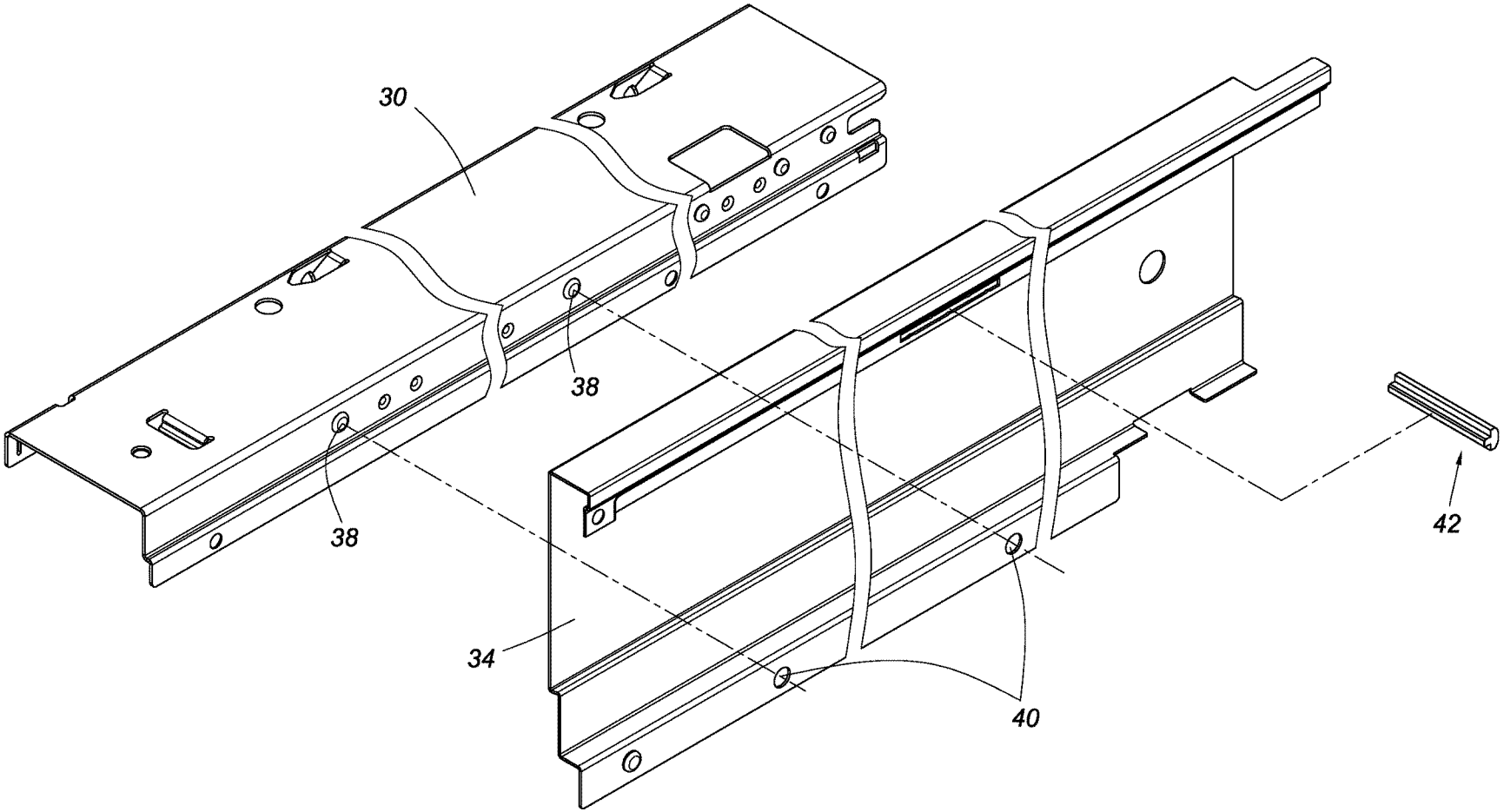
FIG. 3 is an exploded perspective view of the carrier and the inner wall in FIG. 2, plus a buffer.

As shown in FIG. 3, the carrier 30 has at least one connecting feature 38, such as a projecting portion, and the inner wall 34 has at least one first mounting feature 40, such as a hole. The connecting feature 38 corresponds in position to the first mounting feature 40 so that the inner wall 34 can be fixedly mounted to the carrier 30 by a fixing means such as soldering, riveting, threaded connection, or the like. The drawer sidewall assembly 16 further includes a buffer 42 to be mounted to the inner wall 34.

Figure 4:
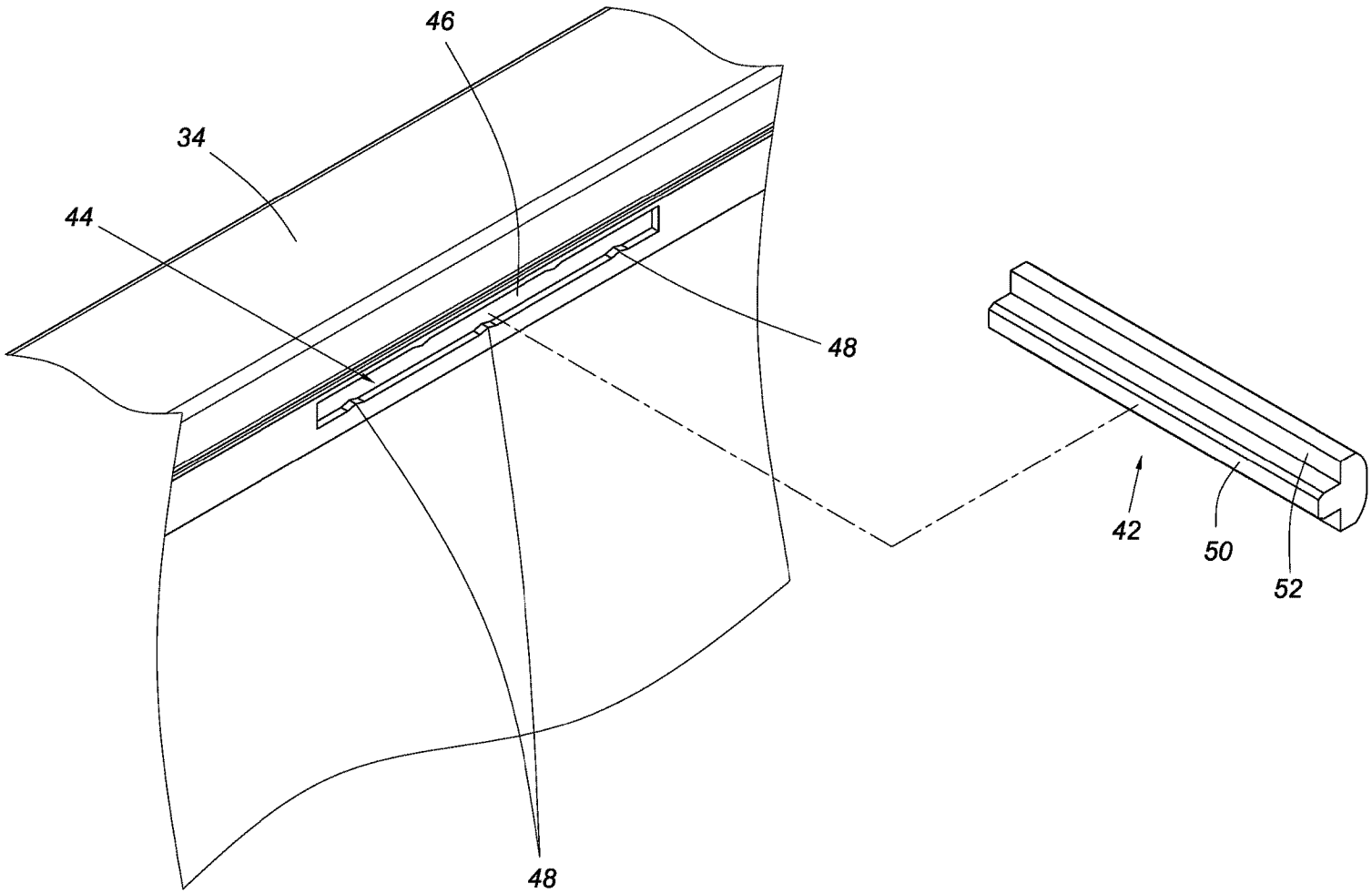
FIG. 4 is an exploded view showing how the buffer is mounted to the inner wall.

FIG. 4 shows that the inner wall 34 further has a second mounting feature 44 for mounting the buffer 42. The second mounting feature 44 includes a mounting hole 46 and a plurality of engaging features 48 distributed along the hole wall of the mounting hole 46. The buffer 42, on the other hand, includes a first buffer portion 50 and a second buffer portion 52 connected to the first buffer portion 50. The first buffer portion 50 is configured to be mounted in the mounting hole 46 of the inner wall 34 and, with the engaging features 48 engaging with the first buffer portion 50, be temporarily fixed in position.

Figure 5:
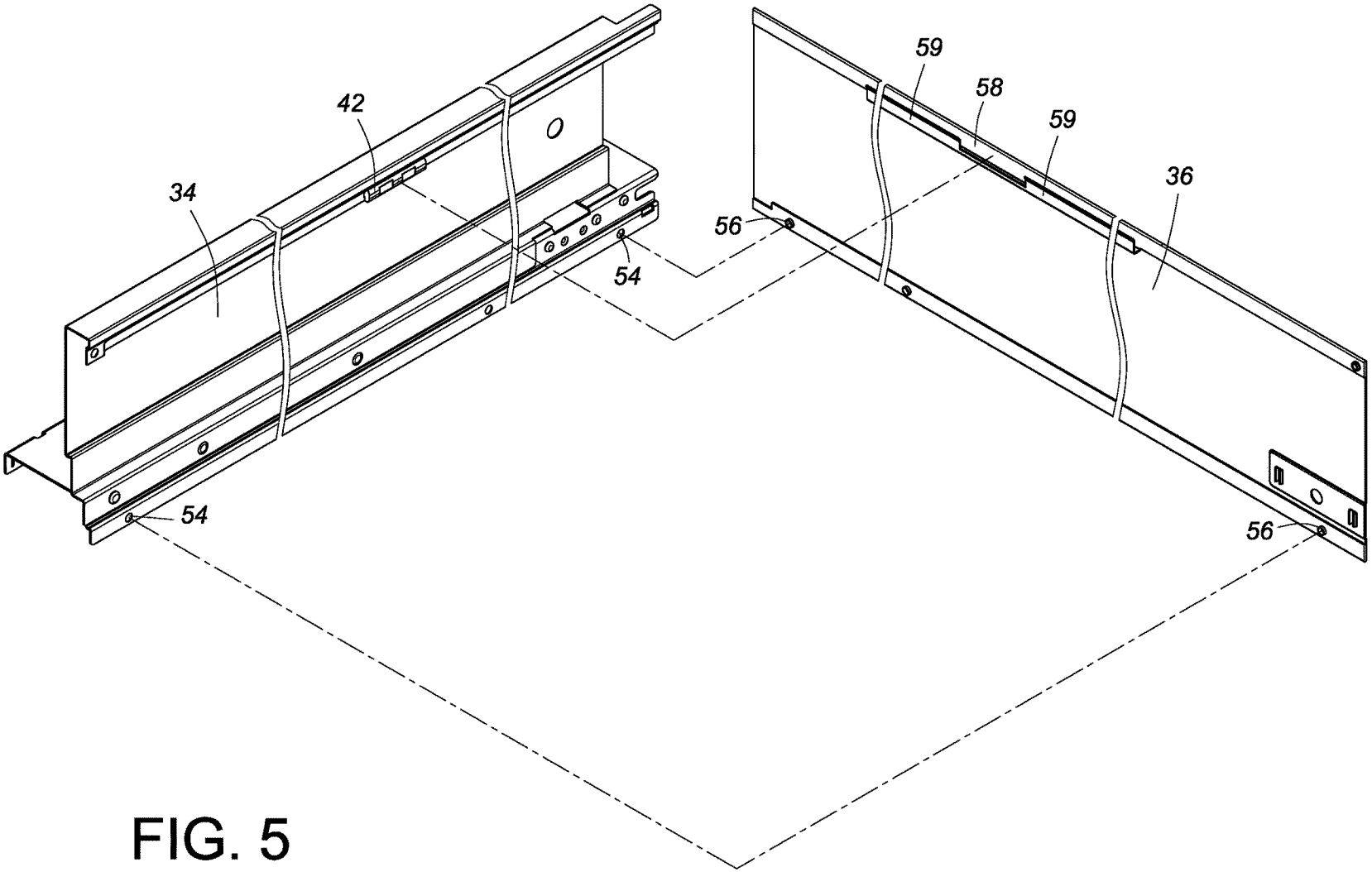
FIG. 5 is an exploded perspective view of the inner wall and the outer wall.

Referring to FIG. 5, the inner wall 34 further has at least one third mounting feature 54 while the outer wall 36 has at least one connecting portion 56. The third mounting feature 54 corresponds in position to the connecting portion 56 so that the inner wall 34 and the outer wall 36 can be securely connected together by a fixing means such as soldering, riveting, threaded connection, or the like. In addition, the outer wall 36 has a contact portion 58 corresponding in position to the buffer 42 and two fastening portions 59 which are adjacent to and respectively located on two lateral sides of the contact portion 58 and are configured to fasten with the inner wall 34.

Figure 6:
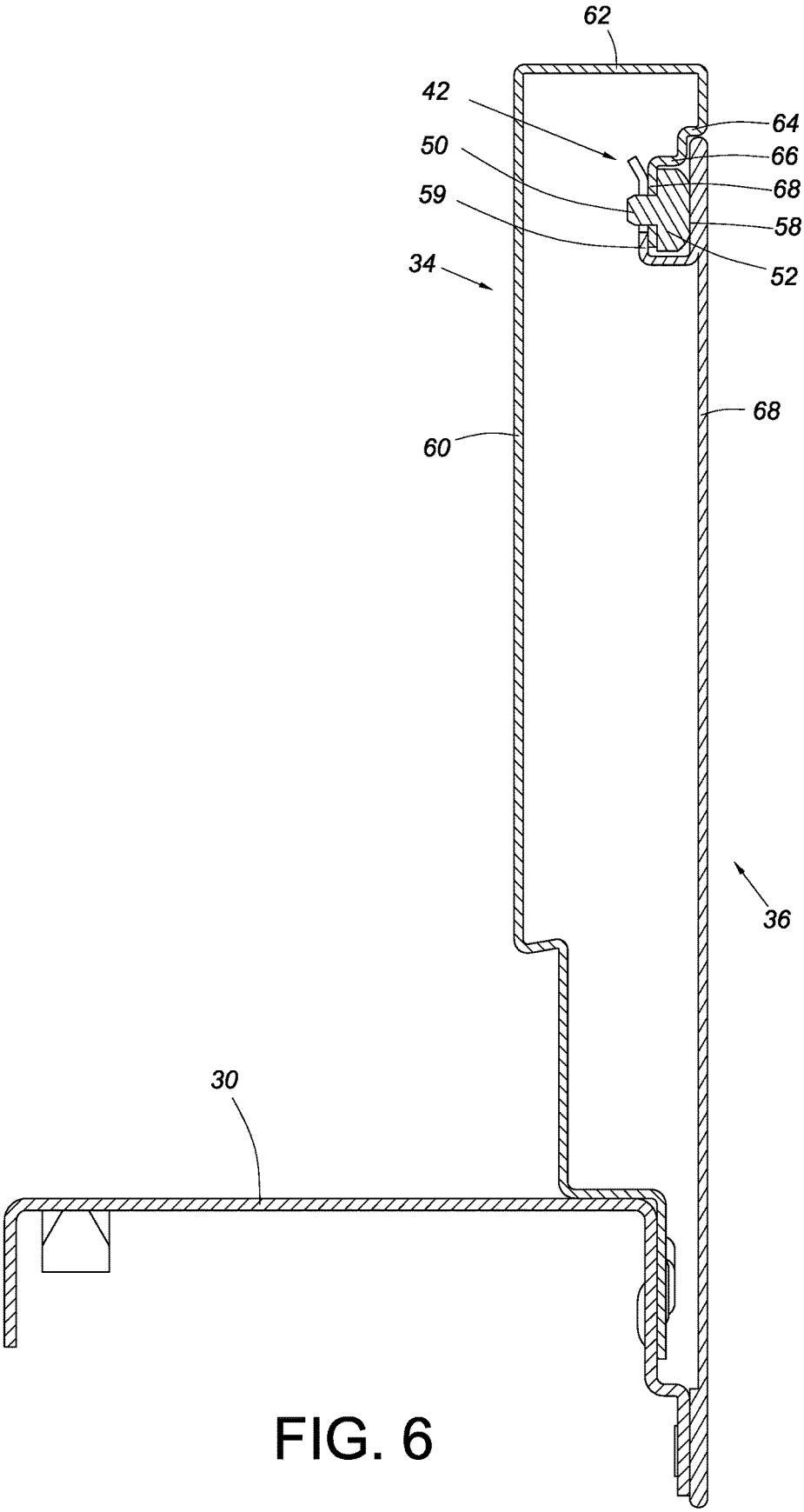
FIG. 6 is a sectional view taken along the line 6-6 in FIG. 2.

Moreover, referring to FIG. 6, the inner wall 34 includes a lateral section 60 and an upper section 62 connected to the lateral section 60. The upper section 62 includes a first bent section 64, a second bent section 66 connected to the first bent section 64, and a vertical section 68 connected to the second bent section 66. The outer wall 36 has a lateral portion 70, and an upper end portion of the lateral portion 70 is configured to be pressed against the first bent section 64 of the inner wall 34. Besides, the contact portion 58 is configured to be pressed against the second buffer portion 52 of the buffer 42, and the fastening portions 59 of the outer wall 36 is configured to fasten with the vertical section 68 of the inner wall 34.

According to the foregoing arrangement of the present invention, the buffer 42 connected between the inner wall 34 and the outer wall 36 can reduce the gap, if any, between the inner wall 34 and the outer wall 36 that is attributable to tolerances of manufacture. Also, the buffer 42 helps absorb vibrations caused by pulling or pushing the drawer.

While the present invention has been disclosed by way of the preferred embodiment described above, it is understood that the embodiment is not intended to be restrictive of the scope of the invention. The scope of patent protection sought by the applicant is defined by the appended claims.

What is claimed is:

1. A drawer sidewall assembly, comprising:
an inner wall;
an outer wall connected to the inner wall; and
a buffer between the inner wall and the outer wall;
wherein the inner wall has a mounting hole and at least one engaging feature on a hole wall of the mounting hole, and the buffer is mounted in the mounting hole of the inner wall and is temporarily fixed in position by the at least one engaging feature engaging with the buffer.

2. The drawer sidewall assembly of claim 1, wherein the buffer includes a first buffer portion and a second buffer portion connected to the first buffer portion, the at least one engaging feature engages with the first buffer portion, and the outer wall has a contact portion pressed against the second buffer portion of the buffer.

3. The drawer sidewall assembly of claim 1, wherein the inner wall and the outer wall are fixed to each other at least partially by riveting or soldering.

4. The drawer sidewall assembly of claim 1, further comprising a carrier connected to the inner wall.

5. The drawer sidewall assembly of claim 4, wherein the carrier is fixed to the inner wall by riveting or soldering.

6. A drawer sidewall assembly, comprising:
an inner wall;
an outer wall connected to the inner wall; and
a buffer between the inner wall and the outer wall;
wherein the inner wall includes a lateral section and an upper section connected to the lateral section, the upper section has a first bent section, the outer wall has a lateral portion, and the lateral portion has an upper end portion pressed against the first bent section of the inner wall.

7. The drawer sidewall assembly of claim 6, wherein the upper section further has a second bent section connected to the first bent section and a vertical section connected to the second bent section, and the outer wall has a fastening portion fastened with the vertical section of the inner wall.

* * * * *